US005716312A

United States Patent [19]

Kristel

[11] Patent Number: 5,716,312

[45] Date of Patent: Feb. 10, 1998

[54] VACUUM CYLINDER

[76] Inventor: Ira B. Kristel, 900 Grand Blvd., Deer Park, N.Y. 11729

[21] Appl. No.: 585,570

[22] Filed: Jan. 16, 1996

[51] Int. Cl.[6] ..... B31B 01/48

[52] U.S. Cl. ..... 493/245; 493/257; 493/418; 493/434; 493/450; 493/453; 53/381.6; 53/382.2

[58] Field of Search ..... 53/381.6, 382.2, 53/460; 493/245, 453, 418, 434, 450, 354, 257; 162/368, 370; 156/568; 270/52.24, 58.07, 52.14

[56] References Cited

U.S. PATENT DOCUMENTS

| | | | |
|---|---|---|---|
| 2,473,069 | 6/1949 | Niks | 162/368 |
| 3,037,557 | 6/1962 | Faeber et al. | 162/370 |
| 3,689,061 | 9/1972 | Nystrand | 493/418 |
| 4,091,596 | 5/1978 | Jones | 53/460 |
| 4,838,982 | 6/1989 | Klaeser et al. | 162/370 |
| 5,135,614 | 8/1992 | Aula et al. | 162/370 |
| 5,155,973 | 10/1992 | Hipko et al. | 53/460 |
| 5,176,611 | 1/1993 | VerMehren | 493/963 |
| 5,223,812 | 6/1993 | Coppola | 53/460 |
| 5,538,575 | 7/1996 | Hinton | 156/568 |

FOREIGN PATENT DOCUMENTS

| | | | |
|---|---|---|---|
| 2023551 | 1/1980 | United Kingdom | 493/245 |

*Primary Examiner*—John Sipos
*Assistant Examiner*—Gene L. Kim
*Attorney, Agent, or Firm*—Scully, Scott, Murphy & Presser

[57] ABSTRACT

A vacuum cylinder is disclosed. The vacuum cylinder may be used in an envelope manufacturing machine, or machines for manufacturing other articles, to facilitate folding of articles about a preformed fold line, such as envelope seal flaps, during the manufacturing process. The vacuum cylinder has at least two rows of suction holes which are arranged at least substantially adjacent to each other and preferably overlap to a certain extent.

22 Claims, 5 Drawing Sheets

FIG. 3

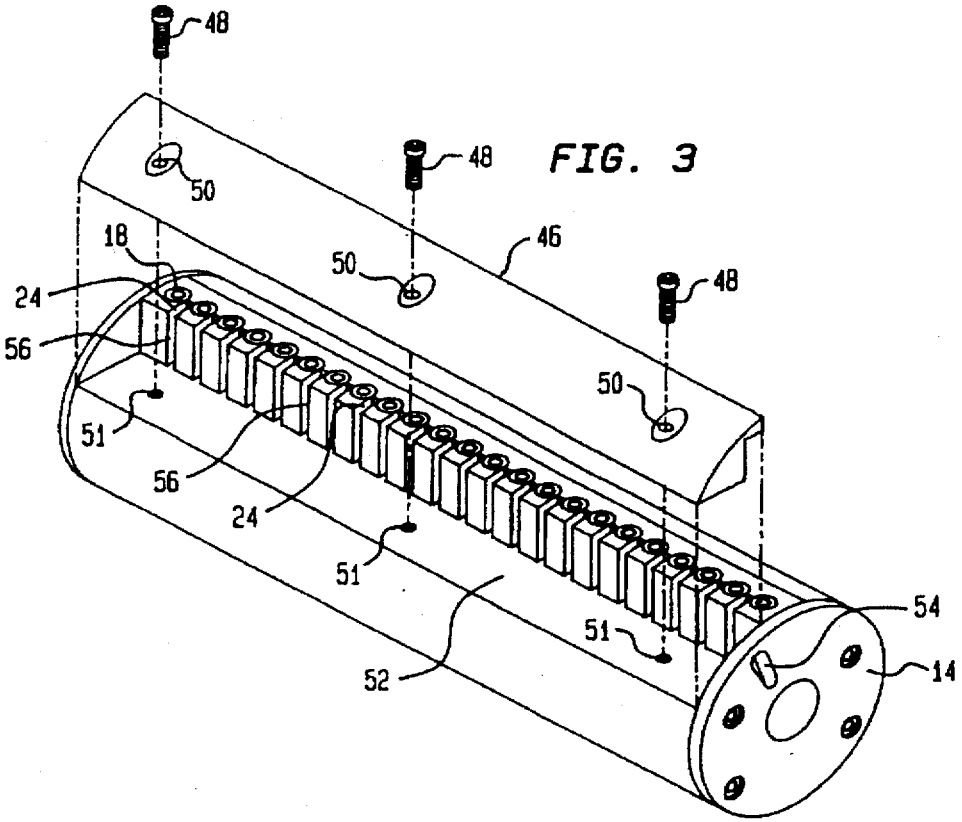
FIG. 3
FIG. 4
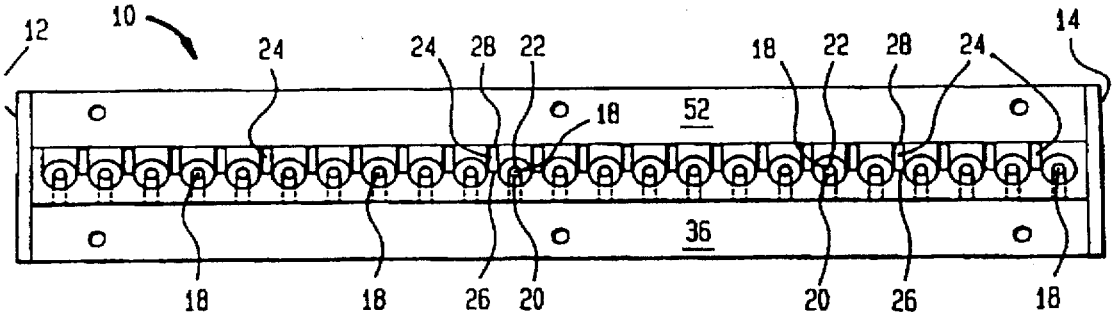

| FIG. 8B | FIG. 8A |
|---|---|

VACUUM CYLINDER

FIELD OF THE INVENTION

The present invention relates to seal flap folding devices. More particularly, the present invention relates to vacuum cylinders for use in envelope manufacturing machines for facilitating folding of the seal flaps of envelopes during the manufacturing process.

BACKGROUND OF THE INVENTION

High speed envelope manufacturing machines are currently used by companies such as Commercial Envelope Manufacturing Company of Deer Park, N.Y., which must meet demands to produce large quantities of various sized envelopes. These envelope manufacturing machines have the capability of producing envelopes at speeds well in excess of 1,000 envelopes per minute and are typically microprocessor controlled high speed web machines which are designed to perform every aspect of envelope manufacture beginning with unwinding of a continuous web of fibrous material, printing of desired information on the fibrous web, feeding and cutting of the web, application of adhesive in selected locations, creation of cut-out or translucent windows, folding of desired flaps, and delivery of completed envelopes.

Such envelope manufacturing machines are produced by various companies such as Winkler and Dünnebier Maschinenfabrik KG and F.L. Smithe Machine Company. Winkler and Dünnebier manufactures several models of high speed rotary-reel-fed envelope machines. For example, envelope manufacturing machines are sold by Winkler and Dünnebier under the trademarks HELIOS 102, HELIOS 399 H, and HELIOS 202.00. F.L. Smithe also manufactures various types of high speed roll-fed envelope manufacturing machines. One such machine is marketed under the trademark CHAMPION MODEL SW.

A shortcoming of all of the aforementioned envelope manufacturing machines is that they have heretofore been limited in their production capability based on the size and type of envelopes desired. For example, although Winkler and Dünnebier's HELIOS 202.00 reel-fed envelope machine has the capability of manufacturing relatively small lightweight envelopes at speeds in excess of 1,300 envelopes per minute, it has been found that this machine can only produce approximately 1,000 envelopes per minute when a 6 inch by 10½ inch 24 pound envelope is desired. These results were achieved when a seal flap folding vacuum cylinder was exposed to 21 in. Hg of vacuum pressure.

All known high speed envelope manufacturing machines utilize vacuum cylinders in conjunction with a seal flap folding trap whereby the vacuum cylinders are designed to grasp the individual envelopes from the seal flap folding trap and to thereafter effect folding of the envelope's seal flap. Prior art seal flap vacuum cylinders include a single row of holes or multiple spaced rows of holes which are in communication with a vacuum chamber so that a negative pressure environment is created which will be sufficient to grasp the envelopes at a desired location with respect to a preformed seal flap folding line. As the envelopes are grasped at the desired location and are drawn between the vacuum cylinder and a cooperating cylinder, the seal flaps are urged to a folded position. This is typically the last step prior to delivery of envelopes from an envelope manufacturing machine.

When attempts were made to run prior art envelope manufacturing machines at speeds greater than approximately 1,000 envelopes per minute in connection with 6 inch by 10½ inch 24 pound envelopes, the envelopes would fly off of the vacuum cylinders because sufficient gripping force was not applied to the envelope adjacent to the preformed fold line of the seal flap.

Thus, despite the great potential of prior art envelope manufacturing machines, limitations on envelope production speed existed due to the structure and operation of prior art seal flap folding vacuum cylinders. Limitations on envelope production speed have also existed in the prior art as a result of flap folding other than envelope seal flaps. For example, the bottom flap of envelope has also been folded by using prior art vacuum cylinders. Since such vacuum cylinders do not provide sufficient gripping force, production speed was also limited due to the speed at which the bottom flaps of envelopes could be folded. This was particularly a problem when "v-flap" envelopes were manufactured.

SUMMARY AND OBJECTS OF THE INVENTION

The present invention solves the aforementioned shortcomings of prior art envelope manufacturing machines by providing a vacuum cylinder having a novel structure and operation which permits envelopes to be manufactured at a substantially higher production rate than has heretofore been possible.

In accordance with a first aspect of the present invention, a flap folding device is provided. The flap folding device preferably comprises a vacuum cylinder having a first row of suction holes and a second row of suction holes arranged at least substantially adjacent to the first row of suction holes. A vacuum chamber may be arranged within the vacuum cylinder in fluid communication with the first and second rows of suction holes. Drive means are operatively associated with the vacuum cylinder for rotating the vacuum cylinder about a longitudinal axis. Vacuum means may also be provided for generating a negative pressure environment within the at least one vacuum chamber and the first and second rows of suction holes whereby the first and second row of suction holes are adapted to grasp the articles to be folded along a preformed fold line during rotation of the vacuum cylinder upon application of the negative pressure environment to an associated article. The flap folding device of the present invention preferably comprises a first vacuum chamber connected to the first row of suction holes and a second vacuum chamber connected to the second row of suction holes.

The at least one vacuum chamber preferably comprises a first vacuum chamber connected to the first row of suction holes and a second vacuum chamber connected to the second row of suction holes. The vacuum means of the flap folding device preferably comprises at least one vacuum pump. In a particularly preferred embodiment, the vacuum means may comprise a first vacuum pump associated with the first vacuum chamber, and a second vacuum pump associated with the second vacuum chamber. Alternatively, a single vacuum pump may be associated with both vacuum chambers through separate vacuum lines.

The flap folding device may also comprise valve means operatively associated with the vacuum means for providing independent control of the negative pressure environments in the first and second chambers. In an embodiment where the vacuum means comprises first and second vacuum pumps, the valve means may comprise a first valve operatively associated with the first vacuum pump for providing independent control of the negative pressure environment in the first vacuum chamber, and a second valve operatively associated with the second vacuum pump for providing independent control of the negative pressure environment in the second vacuum chamber.

The geometric configuration of the first and second rows of vacuum holes may vary in alternate embodiments. In one preferred embodiment, the first row of suction holes may have a plurality of substantially round apertures and the second row of suction holes may comprise a plurality of substantially square apertures. In other embodiments, the first and second rows of suction holes may have geometric configurations other than substantially round and substantially square configurations.

It is preferable for the first and second rows of suction holes to overlap to a certain extent whereby the front end of the second row of suction holes is arranged in front of the rear end of the first row of suction holes.

The flap folding device of the present invention may be used to fold the flaps at various locations along preformed fold lines of envelopes. One preferred application pertains to the folding of the envelope seal flap where the suction holes of the vacuum cylinder grasp the seal flap at a location immediately adjacent or close to a preformed fold line of an envelope. In another preferred application, the present vacuum cylinder may be used to fold the bottom flap of envelopes.

The flap folding device of the present invention may also be used to fold flaps of articles other than envelopes. For example, the flap folding device may be used to fold tissues, napkins, and the like.

In accordance with an additional aspect of the present invention, an envelope manufacturing machine is provided. The envelope manufacturing machine in accordance with this aspect of the present invention comprises means for unwinding a wound web of cellulosic material and means for cutting the web of cellulosic material as it becomes unwound. The envelope manufacturing machine may also comprise means for performing a plurality of folding operations on the cellulosic material either before or after the web has been cut. Adhesive application means are also provided for applying an adhesive composition on selected portions of the cut and folded cellulosic material. Seal flap folding means including a seal flap trap adapted to receive at least partially folded envelopes, and a vacuum cylinder so that at least one additional seal flap folding cylinder operatively associated with the vacuum cylinder to facilitate folding of envelope seal flaps can also be provided as part of the envelope manufacturing machine. The vacuum cylinder may be adapted to remove one envelope at a time from the seal flap trap. To this end, the vacuum cylinder may have some or all of the features of the vacuum cylinder discussed above in connection with the first aspect of the present invention.

The vacuum cylinder of the present invention may also be used to fold envelope flaps other than the seal flap. For example, it may be used to fold the bottom flap of envelopes. Folding of the bottom flap may be particularly important if a "v-flap" envelope is being manufactured.

It is an object of the present invention to provide a flap folding device which will substantially increase the production rate of envelope manufacturing machines.

It is another object of the present invention to provide a flap folding device which will substantially increase the production rate of machines which manufacture various cellulosic products such as tissue, napkins, and the like.

It is yet another object of the present invention to provide a modified vacuum cylinder for folding the flaps of envelopes, such as seal flaps and bottom flaps which will prevent envelopes from flying off the vacuum cylinder when operated at production speeds greater than those which have heretofore been achieved with like sized envelopes.

These and other objects and features of the present invention will be more clearly understood when considered in conjunction with the following detailed description of the preferred embodiments and drawings of the present invention.

BRIEF DESCRIPTION OF THE DRAWINGS

FIG. 3 is a perspective elevational view of an opposite side of the vacuum cylinder shown in FIG. 1 with a second cover portion removed exposing a second vacuum chamber.

FIG. 4 is a top plan view of the vacuum cylinder shown in FIG. 1 with both cover portions removed exposing both vacuum chambers.

DETAILED DESCRIPTION OF THE PREFERRED EMBODIMENTS

The present invention pertains to a vacuum cylinder which may be used to facilitate folding of various objects about a preformed fold line. In a preferred embodiment, the present vacuum cylinder is used to fold the flaps of envelopes, such as the seal flap, a bottom flap or a side flap. Although the term "seal flap" will be used herein to provide an example of preferred use of the present vacuum cylinder, it should be understood that that term is also intended to cover bottom flaps and side flaps of envelopes. Further, the present vacuum cylinder may be useful for folding various articles, other than envelopes, about a preformed fold line. Examples of such additional articles include napkins, tissues and the like.

The present invention is also directed toward an envelope manufacturing machine which utilizes a vacuum cylinder having the novel features discussed herein to perform folding operations. This aspect of the present invention will be discussed after the structure of a preferred vacuum cylinder is described.

A preferred embodiment of the vacuum cylinder of the present invention is generally designated 10 in FIGS. 1–7. The vacuum cylinder 10 may be made of various suitable materials including cast iron, steel, aluminum and the like.

The dimensions of the vacuum cylinder 10 may vary depending upon the machine in which it is used. In a preferred embodiment, the vacuum cylinder 10 may be between about five and thirty inches long and may have an outer diameter between about three and twelve inches.

As best shown in FIGS. 1–4 and 8, the vacuum cylinder 10 includes a first end 12 and a second end 14. The first end 12 may be arranged on the drive side of an envelope manufacturing machine as it may be adapted to receive a drive shaft. The second end 14 may be arranged at an operator's side of an envelope manufacturing machine which is the side at which operating personnel may stand to perform adjustments that may be necessary during the envelope manufacturing process.

Figure 1:
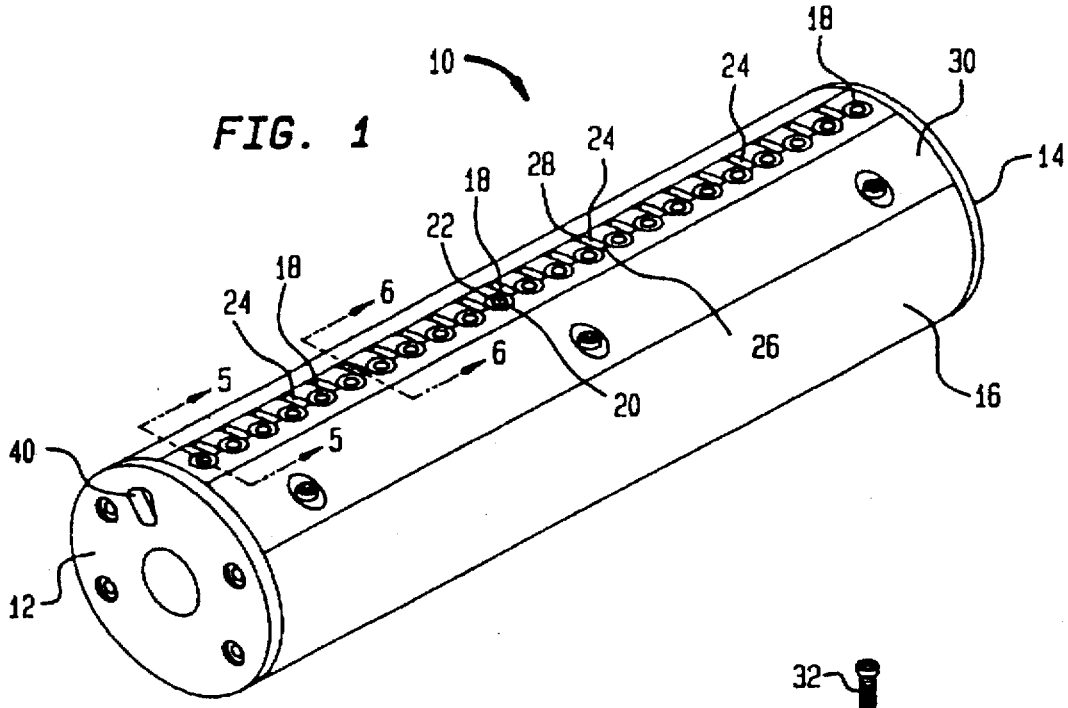
FIG. 1 is a perspective elevational view of a vacuum cylinder in accordance with a preferred embodiment of the present invention.

The outer surface 16 of the vacuum cylinder 10 appears to be substantially continuous as shown in FIG. 1 when the vacuum cylinder 10 is in assembled position.

One feature which clearly distinguishes the vacuum cylinder 10 from prior art cylinders is that it includes at least two rows of holes 18 and 24 which extend longitudinally along the surface 16 between the first end 12 and the second end 14 wherein the rows of holes 18 and 24 at least substantially adjacent to each other. As shown in the preferred embodiment of FIGS. 1–6, the first row of holes 18 may include approximately 23 substantially round apertures. A round plastic insert (unnumbered) may be arranged within each of the holes 18. The second row of holes 24 comprise a plurality of substantially square shaped slots arranged between the holes 18. The holes 18 include a front end 20 and a rear end 22. The slots 24 include a front end 26 and a rear end 28. As illustrated in FIGS. 1–6, the slots 24 overlap the holes 18 as the front end 26 of the slots 24 extend to a location between the front end 20 and the rear end 22 of the holes 18.

The placement of the front end 20 of the holes 18 with respect to a preformed fold line about which a flap of an envelope is to be folded is an important aspect of the envelope manufacturing process. To this end, if the front end 20 of the holes 18 are not placed relatively close (i.e. substantially adjacent) to a preformed fold line of a flap, the flap may be improperly folded. Thus, the interaction between the holes 18 and the slots 24 with respect to a preformed fold line of an envelope are discussed in detail below with particular reference to FIG. 9.

FIGS. 2–6 illustrate various views of the vacuum cylinder 10 which expose a first vacuum chamber 36 and a second vacuum chamber 52 therein. When the vacuum cylinder 10 is fully assembled, a removable cover 30 which may be made of steel, cast iron, aluminum and the like is arranged over the vacuum chamber 36 with respect to the "hole side" (i.e., the vacuum chamber closest to the first row of holes 18). In a preferred embodiment, the cover 30 may be removably secured to the vacuum cylinder 10 by several mounting screws 32 which extend through passageways 34 in the cover 30 and aligned threaded passageways 38 arranged at the base of the vacuum chamber 36. FIGS. 2, 3, 5 and 6 illustrate a vacuum port 54 which is arranged in the second side 14 of the vacuum cylinder 10 to connect the vacuum chamber 36 with a vacuum source 64 which will be discussed further below.

Figure 5:
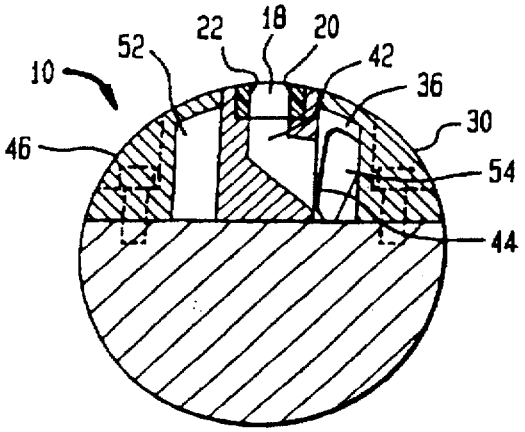
FIG. 5 is a cross-sectional side view of a preferred embodiment of the present vacuum cylinder with both covers in assembled position taken along line V—V of FIG. 1.

As best shown in FIG. 5, each of the holes 18 includes a passageway 42 which extends from the external aperture of the holes 18 into the body of the vacuum cylinder 10. A plurality of corresponding interval apertures 44 denote openings to the passageway 42 within the vacuum chamber 36. This will permit the vacuum environment within vacuum chamber 36 to be applied through the passageways 42 and the corresponding holes 18 so that an article may be grasped during the manufacturing process. Thus, the vacuum chamber 36 may be said to be in fluid communication with the holes 18.

The "slot slide" of the vacuum cylinder 10 is the portion of the vacuum chamber 52 which is closest to the second row of holes (i.e., slots) 24. The slot side also includes a cover 46 which is removably mounted over the second vacuum chamber 52. To this end, a plurality of mounting screws 48 extend within passageways 50 of the cover 46, and into aligned threaded passageways 51 at the bottom of the vacuum chamber 52.

Figure 2:
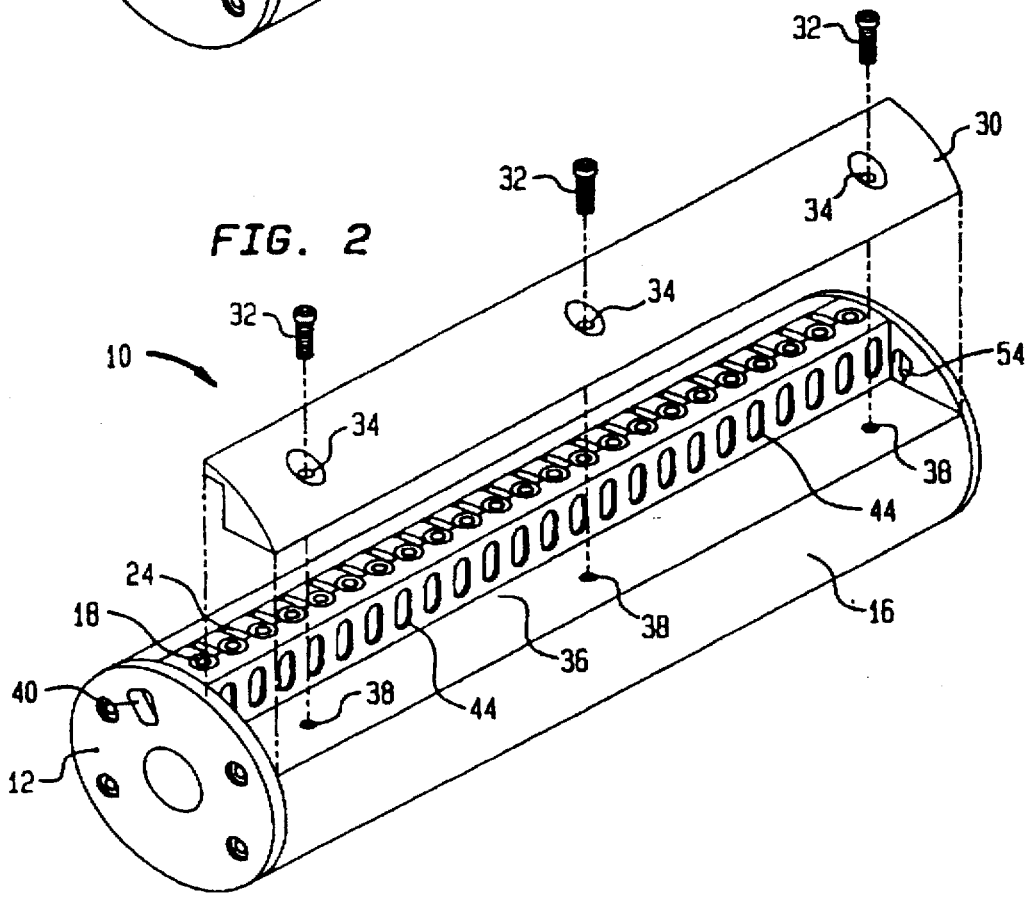
FIG. 2 is a perspective elevational view of the vacuum cylinder shown in FIG. 1 with a first cover portion removed exposing a first vacuum chamber.
Figure 6:
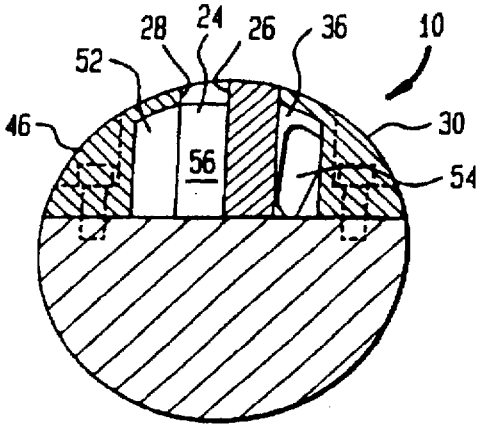
FIG. 6 is a cross-sectional side view of a preferred embodiment of the vacuum cylinder of the present invention with both covers in assembled position taken along line VI—VI of FIG. 1.

As shown in FIGS. 1 and 2, a vacuum port 40 extends within the first end 12 of the vacuum cylinder 10 so that a separate vacuum pump 58 (See FIG. 7) can create a vacuum environment within the vacuum chamber 52. As illustrated in FIGS. 3 and 6, each of the slots 24 has a continuously milled passageway 56 which extends from the surface 16 of the vacuum cylinder 10 through a side wall within vacuum chamber 52. This arrangement permits the vacuum environment within the vacuum chamber to be applied to the surface of an envelope, or other article, through the slots 24. It should be appreciated that although the first row of holes 18 include a substantially round aperture and the second row of holes 24 include a substantially square shaped aperture in the illustrated preferred embodiment, various geometric configurations for the apertures may be used in alternate embodiments. For example, both rows of holes 18 and 24 may be substantially round, substantially square, triangular, or they may have various other geometric configurations. Further, although the embodiment of the vacuum cylinder 10 shown in FIGS. 1–6 discloses a row of slots 24 having a continuously milled passageway 56 which extends into the vacuum chamber 52, various other passageway arrangements may be used in alternate embodiments so long as the vacuum environment created in vacuum chamber 52 is permitted to fluidly communicate with the slots 24. Similarly, the configuration of the passageways 42 and the apertures 44 are not critical as various alternate configurations may be used to connect the vacuum chamber 36 with the holes 18.

It is important for the first row of holes 18 and the second row of holes 24 (e.g. slots) to be at least substantially adjacent to each other. As discussed above, in a particularly preferred embodiment, the first row of holes 18 and the second row of holes 24 overlap to a certain extent.

Figure 7:
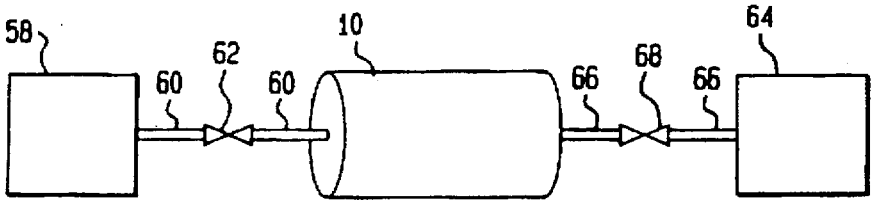
FIG. 7 is a schematic representation of the vacuum cylinder of the present invention in association with a pair of vacuum pumps and a pair of vacuum valves.

FIG. 7 illustrates a schematic view of the arrangement between the vacuum cylinder 10 and a pair of vacuum sources. In alternate embodiments of the present invention, a single vacuum source may be used to create a vacuum environment within vacuum chambers 36 and 52. However, in the preferred embodiment of the present invention shown in FIG. 7, a first vacuum pump 58 is shown in correspondence with tubing 60 and a first valve 62. The tubing 60 also extends between the first valve 62 and the vacuum port 40 arranged at the first end 12 of the vacuum cylinder 10. Thus, the vacuum pump 58 is used to create a vacuum environment within the vacuum chamber 52. The vacuum environment within vacuum chamber 36 is created by a separate vacuum system which comprises second vacuum pump 64, tubing 66 and a second valve assembly 68. For reasons which will be more apparent when discussed in connection with the operational aspects of the present invention, the first row of holes 18 and the second row of holes 24 are exposed to separate vacuum environments which cause grasping of an envelope, or other object, adjacent to a preformed fold line. Typical operating vacuum pressures may vary between about 17 inches Hg and 21 inches Hg. However, it should be appreciated that the present invention is not limited to a particular range of vacuum environments. Thus, vacuum environments less than or greater than the aforementioned range may be advantageously used with the vacuum cylinder 10.

Figure 8A:
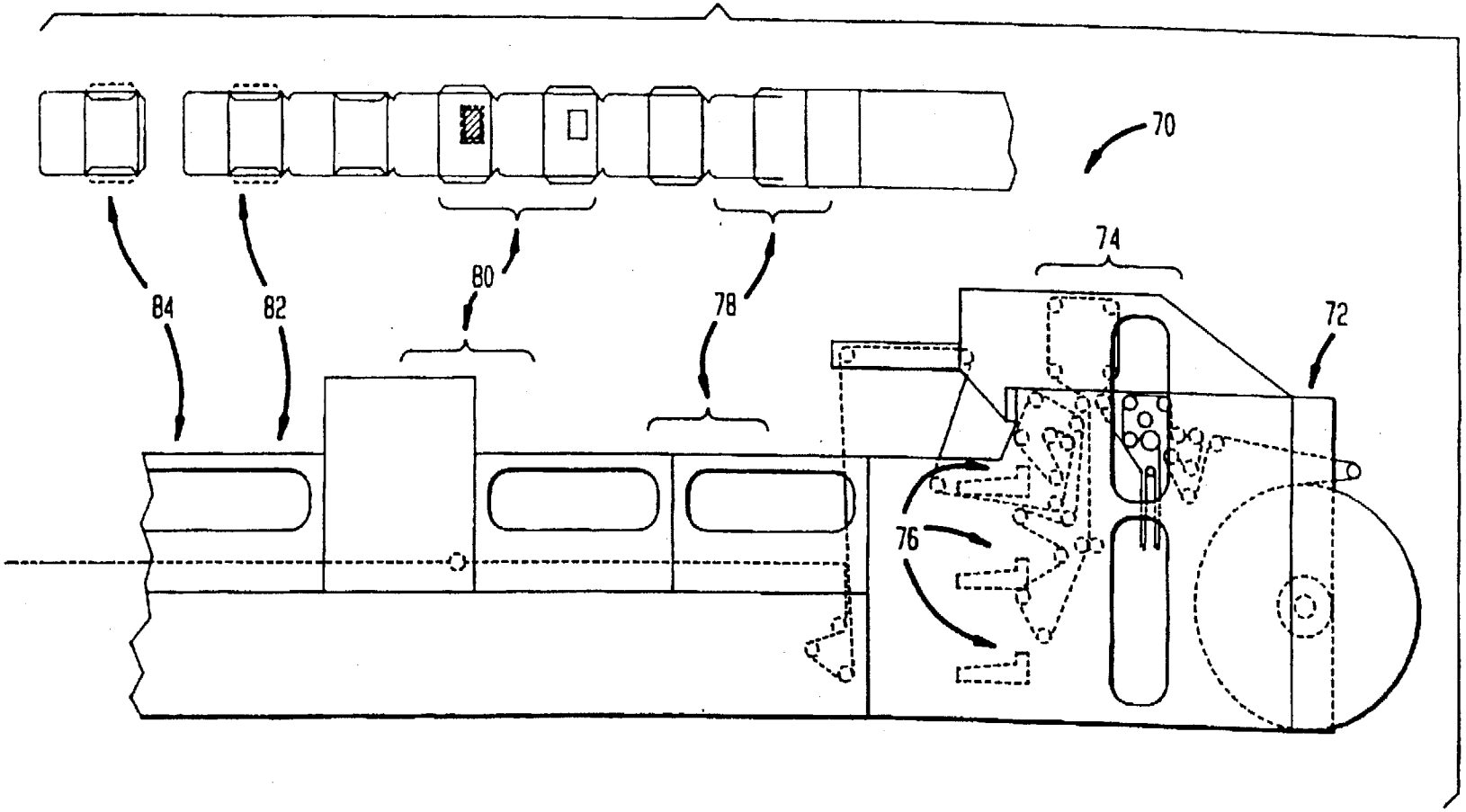
FIG. 8A is a schematic side view of a first portion of an envelope manufacturing machine illustrating different phases of the envelope manufacturing process.
Figures 8, 8B:
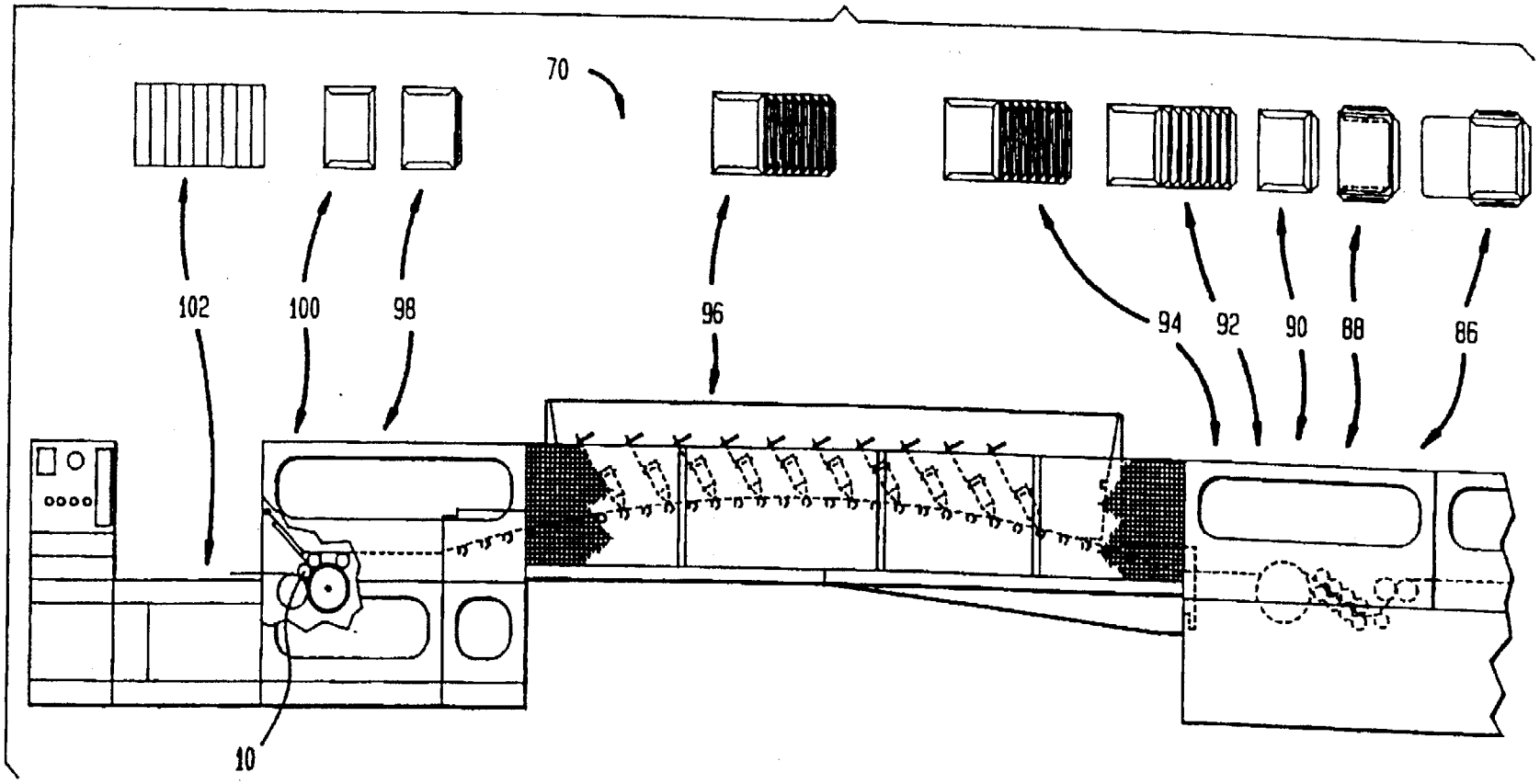
FIG. 8 illustrates a legend which identifies the relationship between the portions of the envelope manufacturing machine shown in FIGS. 8A and 8B.
FIG. 8B is a schematic side view of a second portion of the envelope manufacturing machine shown in FIG. 8A including a vacuum cylinder in accordance with the present invention shown in assembled position and illustrating different phases of the envelope manufacturing process.

An envelope manufacturing machine 70 which may use the vacuum cylinder 10 of the present invention is schematically shown in FIGS. 8A and 8B. The envelope manufacturing machine 70 is shown as two portions because it cannot clearly be shown in a single drawing. However, it should be understood that the two portions shown in FIGS. 8A and 8B are integral and thus represent a single machine 70. The relationship between the machine portions of FIGS. 8A and 8B is clearly shown by the legend of FIG. 8. This type of envelope manufacturing machine is well known in the art. It should be understood that the vacuum cylinder 10 could be used with other types of envelope manufacturing machines in addition to the envelope manufacturing machine 70 illustrated in FIGS. 8A and 8B. Further, as discussed above, the vacuum cylinder 10 may be used to fold various articles other than envelopes about preformed fold lines. However, the operation of the vacuum cylinder 10 and an envelope manufacturing machine which utilizes the vacuum cylinder 10 will be described herein for illustrative purposes with reference to envelope manufacturing machine 70 shown in FIGS. 8A and 8B.

The envelope manufacturing machine 70 may be a comprehensive manufacturing machine which is capable of performing all manufacturing steps from unwinding of a continuous web of paper at a first end of the machine to counting of the manufactured envelopes at the output end of the machine.

A web of paper may be unwound in a manner known in the art at a web unwinding section 72. The unwound web is then aligned at a web alignment section 74 prior to advancement thereof to a printing section 76. The printing section may be capable of printing various colors and messages on selected portions of an envelope. Such printing operations are optional as they are not performed on envelopes which do not require printed matter thereon.

After the printing steps are completed, if necessary, the web is advanced to scoring and cutting sections 78 where the size and configuration of envelope blanks are obtained. The cut envelopes are then advanced to a window cutting section and a material placement section 80, if necessary. This section is responsible for cutting out a window area and placement of a translucent polymeric sheet over the window area after it has been cut. It should be appreciated that this feature, as well as some of the other features discussed therein, are optional features of the disclosed envelope manufacturing machine, as not all envelopes require cut out windows.

After placement of the optional translucent sheet over the window section, the envelope blanks are advanced to a side flap folding section 82 where folding operations on the envelope side flaps are performed. The envelopes are then separated at the separating section 84. This step may be performed by utilizing conveyors operating at different speeds or other ways known in the art.

Adhesive is applied to the side flaps at a side flap adhesive application section 86. The bottom flaps of the envelopes are then folded at a bottom flap folding section 88 and the envelopes are then advanced to an outer side flap folding section 90 where folding operations on the outer side flaps are performed. The envelopes are then staggered at an envelope staggering section 92 prior to advancement to a seal flap adhesive application section 94. This section is known in the art as a "gumming" section.

The adhesive applied to the envelope seal flaps are then dried as the envelopes are advanced through an adhesive drying section 96. As the envelopes continue to advance through the manufacturing machine 70, they are aligned at an envelope alignment section 98 prior to entering a seal flap folding section 100 which is an important section with respect to the present invention.

The seal flap folding section 100 may comprise a seal flap trap (unnumbered), the vacuum cylinder 10 and at least one cooperating cylinder which is operatively associated with the vacuum cylinder 10 for facilitating folding of the envelope seal flaps about a preformed fold line. After the envelope seal flaps have been precisely folded about a preformed fold line, the envelopes are finally advanced to a counting and delivery section 102 at the output end of the envelope manufacturing machine 70.

The manufacturing specifications of a preferred envelope manufacturing machine discussed herein may indicate that the machine is capable of running at motor speeds of greater than 1300 rpm. If there is a one-to-one correspondence between rpm's and the production rate (i.e., envelopes manufactured per minute), the maximum output of such an envelope manufacturing machine may be rated at over 1,300 envelopes per minute—provided that a suitably small and lightweight envelope is being manufactured. The maximum production rate decreases when larger and heavier envelopes are desired. For example, when manufacturing a 6 inch by 10½ inch 24 lb. envelope, the envelope manufacturing machine 70 was heretofore capable of producing approximately 1,000 envelopes per minute when using a conventional vacuum cylinder (e.g., a vacuum cylinder having a single row of suction holes) under a vacuum pressure of about 21 inches Hg. Typical operating vacuum pressures may range between 17–21 inches Hg. Although vacuum pressures greater or less than this preferred range may be applied. Further, conventional vacuum systems may utilize a single vacuum pump and a single valve for creating a vacuum environment within an associated conventional vacuum cylinder.

When the vacuum cylinder 10 is used with the dual vacuum system shown in FIG. 7, as opposed to a conventional vacuum cylinder and vacuum system, it has been found that the output production rate of envelope manufacturing machine 70 increases by at least 15 percent. To this end, where it would previously be possible to obtain an output of about 1000 6 inch×10½ 24 lb. envelopes per minute, use of the vacuum cylinder 10 increases production to about 1,150 envelopes per minute. Similar, or greater, production rate increases may be obtained when it is desired to manufacture various sized envelopes.

Attempts to increase the production rate of prior art envelope manufacturing machines which use conventional vacuum cylinders (i.e., vacuum cylinders having a single row of holes or more than one row of holes spaced at a considerable distance from each other) cause tremendous deficiency in the production rate. To this end, envelopes fly off conventional vacuum cylinders when the cylinders are forced to rotate at speeds which generate centrifugal forces in excess of a gripping force at the hole of the vacuum cylinder. Since the vacuum cylinder 10 of the present invention has a much greater gripping force than conventional vacuum cylinders, problems associated with prior art limitations on production speed have been solved.

Figure 9:
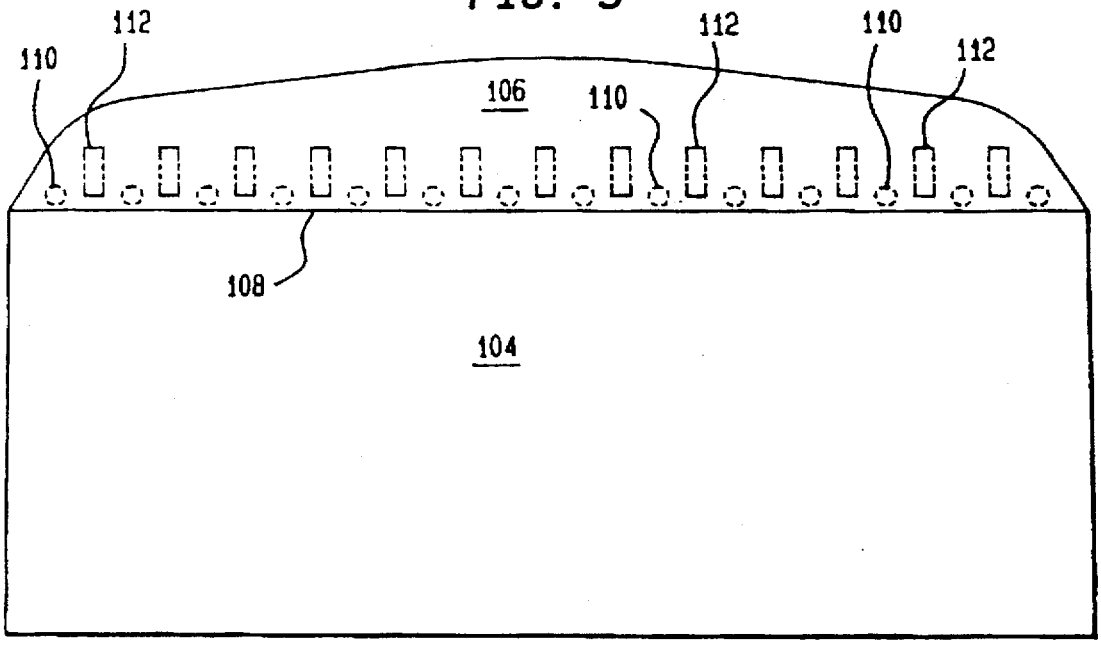
FIG. 9 is a front view of an envelope prior to folding of the seal flap illustrating the intended placement of the first and second rows of holes during the folding process.

In order to more clearly explain the advantages obtained during operation of the vacuum cylinder 10 when used in connection with folding of envelope seal flaps, or the flaps arranged at other portions of an envelope—such as the bottom flap, it is useful to consider the front view of the envelope 104 shown in FIG. 9 prior to folding of the seal flap 106. When the envelope 104 enters the seal flap trap (unnumbered) the seal flap 106 will be arranged adjacent to the vacuum cylinder 10. A preformed fold line 108 separates the seal flap 106 from the body of the envelope 104.

The vacuum cylinder 10 rotates at particularly high speeds and is adapted to grasp one envelope at a time from the seal flap trap in order to obtain precise folding of the seal flap 106 along the preformed fold line 108. This is accomplished by placing the first row of holes 18 and the second row of holes 24 in contact with the envelope seal flap 106 at a preselected location substantially adjacent to the preformed fold line 108 as shown in FIG. 9. The intended placement of the first row of holes 18 is such that the front end 20 thereof is preferably between 0–5 mm from the preformed fold line 108 on the seal flap side of the envelope 104. More preferably, the front end 20 of the first row of holes 18 will be placed about 1 mm from the preformed fold line 108. This arrangement can best be appreciated from FIG. 9 where reference numeral 110 designates the intended placement of the first row of holes 18. The intended placement of the second row of holes 24 is designated by reference numeral 112.

It should be appreciated that the overlap area of the first row of holes 18 and the second row of holes 24 provide for more secured grasping of the envelope seal flaps 106 than has heretofore been achieved the prior art vacuum cylinders. To this end, prior art vacuum cylinders have utilized a either single row of holes, or more than one row of holes which are spaced at a considerable distance from each other.

Another advantageous feature of the present invention is the use of separate vacuum pumps 58 and 64 in association with the corresponding first and second rows of holes 18 and 24. This arrangement will permit envelope manufacturing machines 70 to continue functioning, although to a lesser extent, if a vacuum leak should develop in the vacuum chambers 36 or 52.

As indicated above, the vacuum cylinder 10 may be beneficial for use in folding various envelope flaps, other than the seal flaps. For example, folding of the bottom flap of an envelope is particularly important on a "v-flap" envelope. Thus, use of vacuum cylinder 10 including at least two rows of holes which are either overlapping, or at least substantially adjacent to each other, will enhance the productivity of bottom flap folding in the same manner described hereinabove in connection with folding of the seal flap. Further, the vacuum cylinder 10 may be used in connection with manufacturing machines which obtain folding of other substantially flat articles about a preformed fold line. Thus, the vacuum cylinder 10 may be used to increase the production rate of tissues, napkins, other paper products and the like.

While the foregoing description and figures are directed toward the preferred embodiments of the present invention, it should be appreciated that numerous modifications can be made to various structural features of the present invention. Indeed, such modifications are encouraged to be made to the present vacuum cylinder without departing from the spirit and scope of the invention. Thus, the foregoing description of the preferred embodiments should be taken by way of illustration rather than by way of limitation as the present invention is defined by the claims set forth below.

What is claimed is:

1. A flap folding device for folding flaps on articles comprising: a vacuum cylinder having a first axial row of suction holes and a second axial row of suction holes arranged therein, each of said suction holes of said first row having a front end and a rear end, and each of said suction holes of said second row having a front end and a rear end, said second row of suction holes being arranged to overlap said first row of suction holes so that said front end of said second row of suction holes is arranged in front of said rear end of said first row of suction holes, and vacuum chamber means arranged within said vacuum cylinder in fluid communication with said first and second rows of suction holes; said vacuum chamber means comprising a first vacuum chamber connected to said first row of suction holes, and a second vacuum chamber connected to said second row of suction holes with said first and second vacuum chambers being unconnected; drive means operatively associated with said vacuum cylinder for rotating said vacuum cylinder about a longitudinal axis; and vacuum means for generating a negative pressure environment within said vacuum chamber means and said first and second rows of suction holes for said first and second rows of suction holes to grasp articles to be folded along a preformed fold line during, rotation of said vacuum cylinder upon application of said negative pressure environment to an associated article.

2. The flap folding device of claim 1 further comprising valve means operatively associated with said vacuum means for providing independent control of said negative pressure environments in said first and second vacuum chambers.

3. The flap folding device of claim 1 wherein said first row of suction holes comprises a plurality of substantially round apertures.

4. The flap folding device of claim 3 wherein said second row of suction holes comprises a plurality of substantially square apertures.

5. The flap folding device of claim 1 wherein said second row of suction holes comprises a plurality of substantially square apertures.

6. The flap folding device of claim 1 wherein said vacuum means comprises at least one vacuum pump.

7. The flap folding device of claim 1 wherein said vacuum means comprises a first vacuum pump associated with said first vacuum chamber, and a second vacuum pump associated with said second vacuum chamber.

8. The flap device folding device of claim 1 wherein said vacuum cylinder has a surface extending in a circumferential direction and a longitudinal direction, said longitudinal direction being substantially perpendicular to said circumferential direction, each of said suction holes of said first row being spaced from each other at said surface of said vacuum cylinder along said longitudinal direction thereof, each of said suction holes of said second row also being spaced from each other along said longitudinal direction of said vacuum cylinder surface and being arranged at least partially between each of said suction holes of said first row along said longitudinal direction so that at least a portion of said first and second rows of suction holes overlap with respect to said circumferential direction.

9. A flap folding device of claim 7 further comprising valve means operatively associated with said first and second vacuum pumps for providing independent control of negative pressure environments in said first and second vacuum chambers.

10. A flap folding device of claim 9 wherein said valve means comprises a first valve operatively associated with said first vacuum pump for providing independent control of said negative pressure environment in said first vacuum chamber, and a second valve operatively associated with said second vacuum pump for providing independent control of said negative pressure environment in said second vacuum chamber.

11. The flap device folding device of claim 10 wherein said vacuum cylinder has a surface extending in a circumferential direction and a longitudinal direction, said longitudinal direction being substantially perpendicular to said circumferential direction, each of said suction holes of said first row being spaced from each other at said surface of said vacuum cylinder along said longitudinal direction thereof, each of said suction holes of said second row also being spaced from each other along said longitudinal direction of said vacuum cylinder surface and being arranged at least partially between each of said suction holes of said first row along said longitudinal direction so that at least a portion of said first and second rows of suction holes overlap with respect to said circumferential direction.

12. An envelope manufacturing machine comprising: means for unwinding a wound web of cellulosic material for producing envelopes having flaps; means for cutting said web of cellulosic material; means for performing a plurality of folding operations on said cellulosic material; adhesive application means for applying an adhesive composition on selected portions of said cut and folded cellulosic material; and seal flap folding means for folding the seal flap of manufactured envelopes, said seal flap folding means including a seal flap trap adapted to receive at least partially folded envelopes, and a vacuum cylinder and at least one additional seal flap folding cylinder operatively associated with said vacuum cylinder to facilitate folding of envelope seal flaps, said vacuum cylinder being adapted to remove one envelope at a time from said seal flap trap, said vacuum cylinder having a first axial row of suction holes and a second axial row of suction holes arranged therein each of said suction holes of said first row having a front end and a rear end, and each of said suction holes of said second row having a front end and a rear end, said second row of suction holes being arranged to overlap said first row of suction holes so that said front end of said second row of suction holes is arranged in front of said rear end of said first row of suction holes, and vacuum chamber means arranged within said vacuum cylinder in fluid communication with said first and second rows of suction holes said vacuum chamber means comprising a first vacuum chamber connected to said first row of suction holes, and a second vacuum chamber connected to said second row of suction holes with said first and second vacuum chambers being unconnected; drive means operatively associated with said vacuum cylinder for rotating said vacuum cylinder about a longitudinal axis; and vacuum means for generating a negative pressure environment within said vacuum chamber means and said first and second rows of suction holes for said first and second rows of suction holes to grasp articles to be folded along a preformed fold line during rotation of said vacuum cylinder upon application of said negative pressure environment to an associated article.

13. The flap folding device of claim 12 further comprising valve means operatively associated with said vacuum means for providing independent control of said negative pressure environments in said first and second vacuum chambers.

14. The flap folding device of claim 12 wherein said first row of suction holes comprises a plurality of substantially round apertures.

15. The flap folding device of claim 14 wherein said second row of suction holes comprises a plurality of substantially square apertures.

16. The flap folding device of claim 12 wherein said second row of suction holes comprises a plurality of substantially square apertures.

17. The flap folding device of claim 12 wherein said vacuum means comprises at least one vacuum pump.

18. The flap device folding device of claim 12 wherein said vacuum cylinder has a surface extending in a circumferential direction and a longitudinal direction, said longitudinal direction being substantially perpendicular to said circumferential direction, each of said suction holes of said first row being spaced from each other at said surface of said vacuum cylinder along said longitudinal direction thereof, each of said suction holes of said second row also being spaced from each other along said longitudinal direction of said vacuum cylinder surface and being arranged at least partially between each of said suction holes of said first row along said longitudinal direction so that at least a portion of said first and second rows of suction holes overlap with respect to said circumferential direction.

19. The flap folding device of claim 12 wherein said vacuum means comprises a first vacuum pump associated with said first vacuum chamber, and a second vacuum pump associated with said second vacuum chamber.

20. A flap folding device of claim 19 further comprising valve means operatively associated with said first and second vacuum pumps for providing independent control of negative pressure environments in said first and second vacuum chambers.

21. A flap folding device of claim 20 wherein said valve means comprises a first valve operatively associated with said first vacuum pump for providing independent control of said negative pressure environment in said first vacuum chamber, and a second valve operatively associated with said second vacuum pump for providing independent control of said negative pressure environment in said second vacuum chamber.

22. The flap device folding device of claim 21 wherein said vacuum cylinder has a surface extending in a circumferential direction and a longitudinal direction, said longitudinal direction being substantially perpendicular to said circumferential direction, each of said suction holes of said first row being spaced from each other at said surface of said vacuum cylinder along said longitudinal direction thereof, each of said suction holes of said second row also being spaced from each other along said longitudinal direction of said vacuum cylinder surface and being arranged at least partially between each of said suction holes of said first row along said longitudinal direction so that at least a portion of said first and second rows of suction holes overlap with respect to said circumferential direction.

* * * * *